US008634732B2

(12) United States Patent
Amemiya et al.

(10) Patent No.: US 8,634,732 B2
(45) Date of Patent: Jan. 21, 2014

(54) IMAGE FORMING APPARATUS INCORPORATING THEREIN A FIXING UNIT CAPABLE OF CLEANING A FIXING ROLLER BY MEANS OF AN OIL ROLLER AND A CLEANING ROLLER

(75) Inventors: Masaki Amemiya, Osaka (JP); Yasunori Minakuchi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 187 days.

(21) Appl. No.: 13/292,134

(22) Filed: Nov. 9, 2011

(65) Prior Publication Data

US 2012/0114355 A1 May 10, 2012

(30) Foreign Application Priority Data

Nov. 10, 2010 (JP) ..... 2010-251395

(51) Int. Cl.
*G03G 15/00* (2006.01)

(52) U.S. Cl.
USPC ..... 399/43; 399/67

(58) Field of Classification Search
USPC ..... 399/43, 67, 324–327
See application file for complete search history.

(56) References Cited

U.S. PATENT DOCUMENTS

| | | | | |
|---|---|---|---|---|
| 6,438,334 | B1 | 8/2002 | Honma | |
| 7,107,001 | B2 * | 9/2006 | Kameda | 399/328 |
| 7,630,675 | B2 * | 12/2009 | Tateishi et al. | 399/327 |
| 7,933,542 | B2 * | 4/2011 | Yamazaki | 399/327 |
| 2007/0258739 | A1 * | 11/2007 | Ide et al. | 399/327 |
| 2011/0299896 | A1 * | 12/2011 | Kitami | 399/325 |

FOREIGN PATENT DOCUMENTS

| | | | |
|---|---|---|---|
| JP | 8-220922 | | 8/1996 |
| JP | 2001-013815 | A | 1/2001 |
| JP | 2001-92292 | A | 4/2001 |
| JP | 2006243077 | A * | 9/2006 |
| JP | 2006-276701 | A | 10/2006 |

* cited by examiner

*Primary Examiner* — G. M. Hyder
(74) *Attorney, Agent, or Firm* — Birch, Stewart, Kolasch & Birch, LLP

(57) ABSTRACT

An image forming apparatus includes a fixing roller, a heating section, a pressurizing roller, an oil roller, a first cleaning roller, and a control section. The pressurizing roller is pressed against the fixing roller. The oil roller abuts against the fixing roller and is capable of being rotated by rotation of the fixing roller to apply oil onto a surface of the fixing roller. The first cleaning roller abuts against the oil roller and is capable of being rotated by rotation of the oil roller to clean a surface of the oil roller. When the control section determines that the fixing roller and the pressurizing roller have performed fixing on a predetermined number and more of consecutive sheet surfaces, the control section carries out a first control process which causes the heating section to stop and the fixing roller to rotate for a first predetermined time period after the fixing.

5 Claims, 7 Drawing Sheets

IMAGE FORMING APPARATUS INCORPORATING THEREIN A FIXING UNIT CAPABLE OF CLEANING A FIXING ROLLER BY MEANS OF AN OIL ROLLER AND A CLEANING ROLLER

CROSS REFERENCE

This Nonprovisional application claims priority under 35 U.S.C. §119(a) on Patent Application No. 2010-251395 filed in Japan on Nov. 10, 2010, the entire contents of which are hereby incorporated by reference.

BACKGROUND OF THE INVENTION

The present invention relates to an image forming apparatus incorporating therein a fixing unit capable of cleaning a fixing roller by means of an oil roller and a cleaning roller.

A fixing device incorporated in an electrophotographic image forming apparatus is configured to fix a toner image transferred to a sheet onto the sheet by fusing, mixing and pressure-contacting the toner image by means of a fixing roller incorporating therein a heat source, such as a halogen heater, and a pressurizing roller forming a fixing nip portion between the pressurizing roller and the fixing roller.

The fixing roller is brought into contact with the toner image transferred to the sheet and hence may be stained at its surface with toner. The toner stain thus adhering to the fixing roller causes succeeding sheets to be stained by adhering thereto.

In view of such an inconvenience, a technique has been disclosed for preventing accumulation of toner stain on the fixing roller by a post-heating process in which the temperature of the heating source is controlled to heat the fixing nip portion up to a temperature equal to and higher than the softening point of the toner after backward rotation of the fixing roller at the end of image formation (see Japanese Patent Laid-Open Publication No. 2006-276701).

Besides the technique described in Japanese Patent Laid-Open Publication No. 2006-276701, there is a fixing device including an oil roller and a cleaning roller for preventing toner stain from adhering to the surface of the fixing roller. This fixing device is configured such that the oil roller abuts against the fixing roller while the cleaning roller abuts against the oil roller.

This configuration can prevent the toner stain from adhering to the surface of the fixing roller by enhancing the toner release property of the fixing roller by the oil roller applying oil onto the surface of the fixing roller. However, the toner stain slightly adheres to the fixing roller even in a state of being applied with oil. Because the toner stain thus adhering to the fixing roller is transferred to the oil roller, such toner stain is recovered by the cleaning roller from the oil roller.

With this configuration, however, when the cleaning roller having recovered the toner stain is heated to an elevated temperature by transfer of heat from the fixing roller to the cleaning roller, the toner stain oozes out of the surface of the cleaning roller. The toner stain thus oozing out of the surface of the cleaning roller cools and is firmly fixed onto the oil roller after the end of printing. The toner stain thus firmly fixed is crushed at the beginning of next printing, which causes sheets to be stained.

In view of the problem described above, a feature of the present invention is to provide an image forming apparatus which is capable of preventing sheets from being stained by preventing the toner stain oozing out of the surface of the cleaning roller from being firmly fixed.

SUMMARY OF THE INVENTION

An image forming apparatus according to the present invention includes a fixing roller, a heating section, a pressurizing roller, an oil roller, a first cleaning roller, and a control section. The fixing roller is rotatable. The heating section is configured to heat the fixing roller. The pressurizing roller is pressed against the fixing roller. The oil roller abuts against the fixing roller and is capable of being rotated by rotation of the fixing roller to apply oil onto a surface of the fixing roller. The first cleaning roller abuts against the oil roller and is capable of being rotated by rotation of the oil roller to clean a surface of the oil roller. The control section is configured to control the rotation of the fixing roller and an operation of the heating section.

When the control section determines that the fixing roller and the pressurizing roller have performed fixing on a predetermined number and more of consecutive sheet surfaces, the control section performs a first control process which causes the heating section to stop and the fixing roller to rotate for a first predetermined time period after the fixing.

When the first cleaning roller is heated enough to allow toner stain to ooze out of the surface thereof due to the fixing on the predetermined number and more of consecutive sheet surfaces, the image forming apparatus having the construction described above carries out the first control process which is capable of cooling the first cleaning roller sufficiently to retain the toner stain in the first cleaning roller.

Therefore, the toner stain fails to ooze out of the surface of the first cleaning roller and hence fails to be fixed firmly. For this reason, the image forming apparatus is capable of preventing sheets from being stained.

DETAILED DESCRIPTION OF THE INVENTION

Hereinafter, image forming apparatuses according to embodiments of the present invention will be described in detail with reference to the attached drawings.

Description is first directed to the first embodiment of the present invention.

Figure 1:
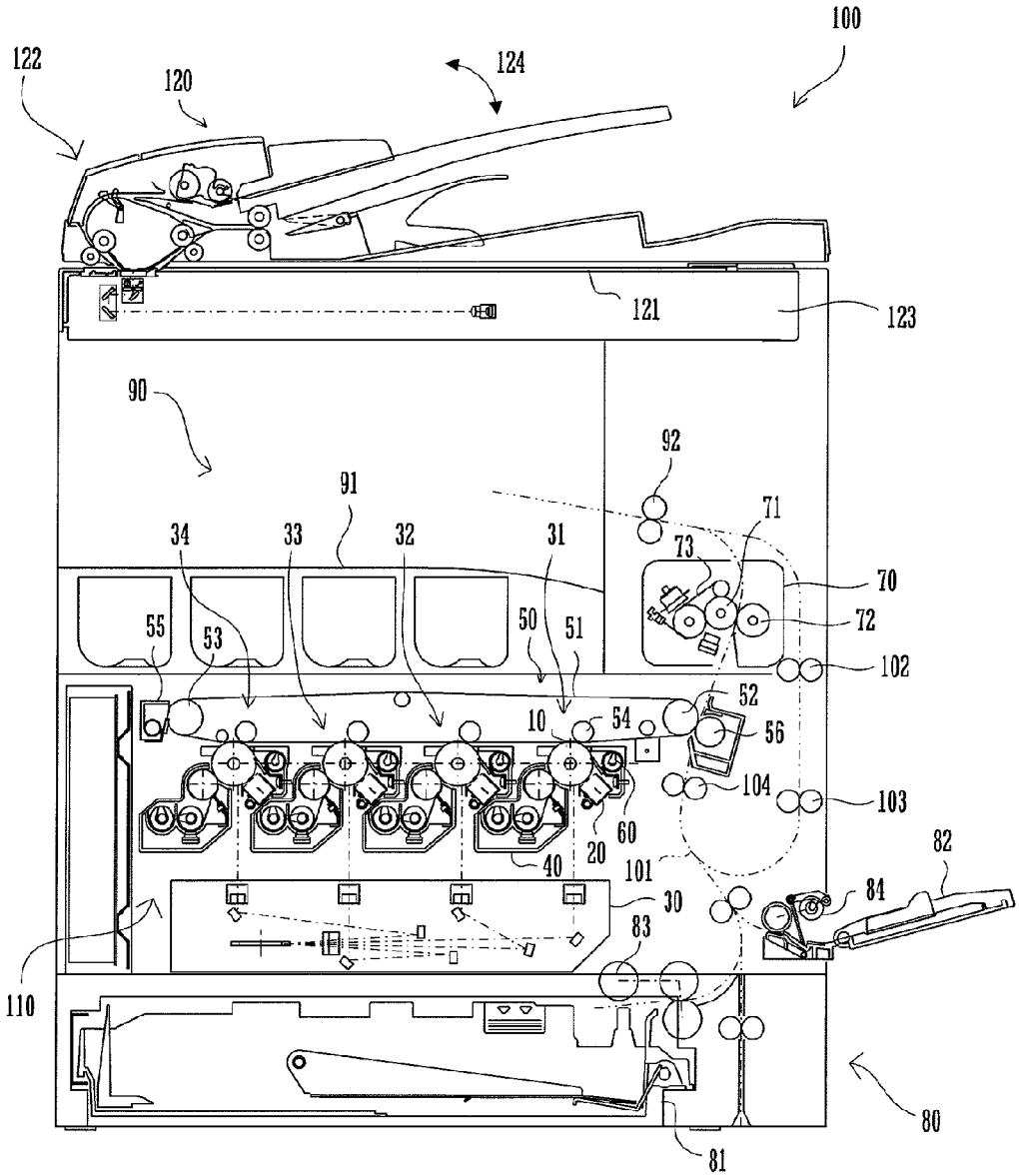
FIG. 1 is a view illustrating a basic configuration of an image forming apparatus according to a first embodiment of the present invention.

FIG. 1 is a view illustrating a basic configuration of an image forming apparatus 100 according to the first embodiment of the present invention.

The image forming apparatus 100 is configured to form a polychrome or monochrome image on a predetermined sheet (i.e., recording sheet) in accordance with image data transmitted thereto from the outside. The image forming apparatus 100 includes an image reading device 200, a sheet feeding section 80, an image forming section 110, and a sheet output section 90.

The sheet feeding section 80 includes a sheet feed cassette 81, a manual feed cassette 82, and pickup rollers 83 and 84. The sheet feed cassette 81 is a tray for holding standard size sheets therein. The manual feed cassette 82 is a tray capable of receiving non-standard size sheets therein. The pickup roller 83, which is located adjacent an end portion of the sheet feed cassette 81, picks up sheets one by one from the sheet feed cassette 81 to feed each sheet to a sheet feed path 101. Likewise, the pickup roller 84, which is located adjacent an end portion of the manual feed cassette 82, picks up sheets one by one from the manual feed cassette 82 to feed each sheet to the sheet feed path 101.

The image forming section 110 includes image forming stations 31 to 34, an exposure unit 30, an intermediate transfer belt unit 50, and a fixing unit 70. The image forming stations 31 to 34 are each provided with a photoreceptor drum 10, an electrostatic charger device 20, a developing device 40, and a cleaner unit 60. The image forming stations 31 to 34 are each associated with a respective one of color images formed using respective colors, i.e., black (K), cyan (C), magenta (M) and yellow (Y). In the present embodiment, description is directed to the image forming station 31.

The photoreceptor drum 10 rotates during image formation and is configured to bear a developer image thereon. Around the photoreceptor drum 10, there are disposed the electrostatic charger device 20, exposure unit 30, developing device 40, intermediate transfer belt unit 50 and cleaner unit 60 in this order from an upstream side in the direction of rotation of the photoreceptor drum 10. The fixing unit 70 is provided on the sheet feed path 101 at a location most downstream in the image forming section 110.

The electrostatic charger device 20 is means for electrostatically charging a peripheral surface of the photoreceptor drum 10 to a predetermined potential uniformly. Besides an electrostatic charger device of the charger type as shown in FIG. 1, a contact-type electrostatic charger device using a roller or a brush may be used.

The exposure unit 30 has the function of exposing the photoreceptor drum 10 in an electrostatically charged state to light according to image data inputted, thereby forming an electrostatic latent image according to the image data on the peripheral surface of the photoreceptor drum 10. The exposure unit 30 is constructed as a laser scanning unit (LSU) having a laser beam emitting section, a reflecting mirror and the like. In the exposure unit 30, there are disposed a polygon mirror for laser beam scanning, and optical components, such as a lens and a mirror, for directing laser light reflected by the polygon mirror to the photoreceptor drum 10. The exposure unit 30 may employ a technique using a writing head having an array of other light-emitting devices, such as ELs or LEDs for example.

The developing device 40 is configured to visualize the electrostatic latent image formed on the photoreceptor drum 10 by using toner.

The intermediate transfer belt unit 50 includes an intermediate transfer belt 51, an intermediate transfer belt driving roller 52, an intermediate transfer belt driven roller 53, an intermediate transfer roller 54, and an intermediate transfer belt cleaning unit 55.

The intermediate transfer belt driving roller 52, intermediate transfer belt driven roller 53 and intermediate transfer roller 54, about which the intermediate transfer belt 51 is entrained, drive the intermediate transfer belt 51 for rotation. The intermediate transfer roller 54 performs application of a transfer bias for transferring the toner image from the photoreceptor drum 10 onto the intermediate transfer belt 51.

The intermediate transfer belt 51 is positioned to come into contact with the photoreceptor drum 10. The intermediate transfer belt 51 has the function of forming the toner image thereon by transfer of the toner image from the photoreceptor drum 10 onto the intermediate transfer belt 51. The intermediate transfer belt 51 is formed into an endless belt by using a film having a thickness of about 100 to about 150 μm for example.

The transfer of the toner image from the photoreceptor drum 10 to the intermediate transfer belt 51 is achieved by the intermediate transfer roller 54 in contact with the reverse side of the intermediate transfer belt 51. The intermediate transfer roller 54 is applied with a high transfer bias voltage (i.e., a high voltage having a polarity (+) opposite to the polarity (−) of the toner charged) in order to transfer the toner image. The intermediate transfer roller 54 is a roller comprising a shaft of metal (e.g., stainless steel) having a diameter of 8 to 10 mm as a base, and an electrically conductive elastic material (e.g., EFDM or urethane foam) covering the surface of the shaft. The electrically conductive elastic material enables the intermediate transfer belt 51 to be uniformly applied with the high voltage. While the present embodiment uses a transfer electrode in the form of a roller, it is possible to use a transfer electrode in the form of a brush or the like.

Electrostatic latent images thus visualized on the respective photoreceptor drums 10 are transferred onto the intermediate transfer belt 51 so as to be superimposed on one another. Image information obtained by superimposition of the toner images is fed by rotation of the intermediate transfer belt 51 to a contact position between a recording sheet and the intermediate transfer belt 51 and is then transferred onto the recording sheet by the transfer roller 56 disposed at the contact position.

At that time, the intermediate transfer belt 51 and the transfer roller 56 are pressed against each other at a predetermined nip pressure, while the transfer roller 56 applied with a voltage for transferring the toner to the recording sheet (i.e., a high voltage having a polarity (+) opposite to the polarity (−) of the toner charged). For obtaining the above-described nip pressure steadily, one of the transfer roller 56 and the intermediate transfer belt driving roller 52 comprises a hard material (e.g., metal or the like) and the other comprises a soft material such as an elastic roller (e.g., elastic rubber roller, expanded resin roller, or the like).

Toner thus attached to the intermediate transfer belt 51 by contact between the photoreceptor drum 10 and the intermediate transfer belt 51 or residual toner remaining on the intermediate transfer belt 51 without having been transferred onto the recording sheet by the transfer roller 56, is removed and recovered by the intermediate transfer belt cleaning unit 55. The intermediate transfer belt cleaning unit 55 includes, for example, a cleaning blade as a cleaning member in contact with the intermediate transfer belt 51. The intermediate transfer belt 51 contacted by the cleaning blade is supported by the intermediate transfer belt driven roller 53 from the reverse side thereof.

The cleaner unit 60 removes and recovers residual toner that remains on the peripheral surface of the photoreceptor drum 10 after the image transfer operation following the developing operation.

The fixing unit 70 includes a fixing roller 71 and a pressurizing roller 72 which are configured to rotate while nipping a sheet therebetween. The fixing roller 71 is controlled by a control section based on signals from a non-illustrated temperature detector so that a predetermined fixing temperature is reached. The fixing roller 71 has the function of fusing, mixing and pressure-contacting the toner image transferred to the sheet by heat-bonding the toner to the sheet cooperatively with the pressurizing roller 71, thereby fixing the toner image onto the sheet by heat. An external heating belt 73 is provided for heating the fixing roller 71 from the outside. Though FIG. 1 shows the external heating belt 73 forming a heating section for heating the fixing roller 71, the heating section is not limited to the external heating belt 73. The heating section may comprise a halogen heater for heating the fixing roller 71 from inside, as will be described later.

The sheet output section 90 has a catch tray 91 and sheet output rollers 92. The recording sheet having passed through the fixing unit 70 is outputted onto the catch tray 91 by passing between the sheet output rollers 92. The catch tray 91 is a tray for accumulating sheets finished with printing.

In cases where double-side printing is requested, when a sheet having been finished with one-side printing as described above and passed through the fixing unit 70 is held between the sheet output rollers 92 at its trailing edge, the sheet output rollers 92 rotate backwardly to feed the sheet to feed rollers 102 and then to feed rollers 103. Thereafter, the sheet is subjected to reverse-side printing after having passed between registration rollers 104 and is then outputted onto the catch tray 91.

Figure 2:
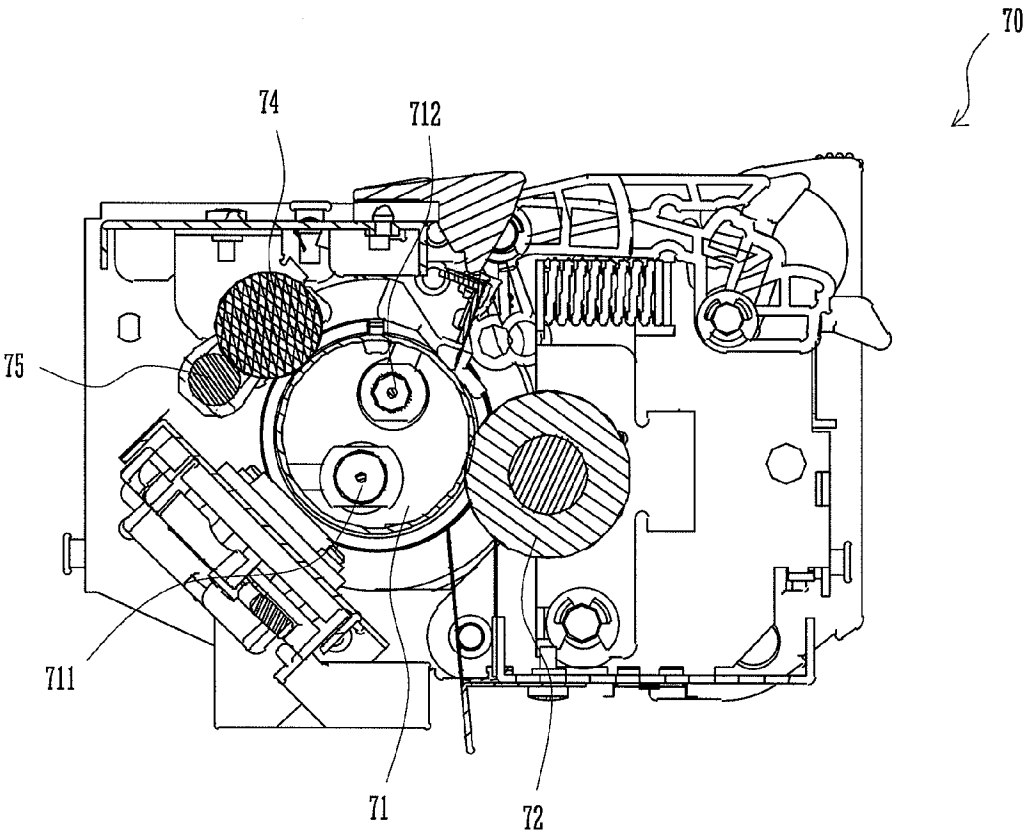
FIG. 2 is a view illustrating a structure of a fixing unit incorporated in the image forming apparatus according to the first embodiment of the present invention.

FIG. 2 is a view illustrating a structure of the fixing unit 70 incorporated in the image forming apparatus 100 according to the first embodiment of the present invention.

The fixing unit 70 includes fixing roller 71, halogen heaters 711 and 712, pressurizing roller 72, oil roller 74, and first cleaning roller 75.

The fixing roller 71 can be driven for rotation. The halogen heaters 711 and 712 are heating media for heating the surface of the fixing roller 71. The halogen heaters 711 and 712 form the "heating section" defined by the present invention. The present embodiment employs an arrangement in which the halogen heater 711 is a heater for heating the entire width of the surface of the fixing roller 71 while the halogen heater 712 is a heater for heating the surface of the fixing roller 71 except end portions thereof.

The pressurizing roller 72 is pressed against the fixing roller 71 and is rotated by rotation of the fixing roller 71. The oil roller 74 abuts against the fixing roller 71 and is rotated by rotation of the fixing roller 71. The oil roller 74 is a roller for applying oil to the surface of the fixing roller 71. The present embodiment uses a sponge roller filled with oil as the oil roller 74.

The first cleaning roller 75 abuts against the oil roller 74 and is rotated by rotation of the oil roller 74. The first cleaning roller 75 is a roller for cleaning the surface of the oil roller 74. The present embodiment uses a solid metal roller as the first cleaning roller 75.

Figure 3:
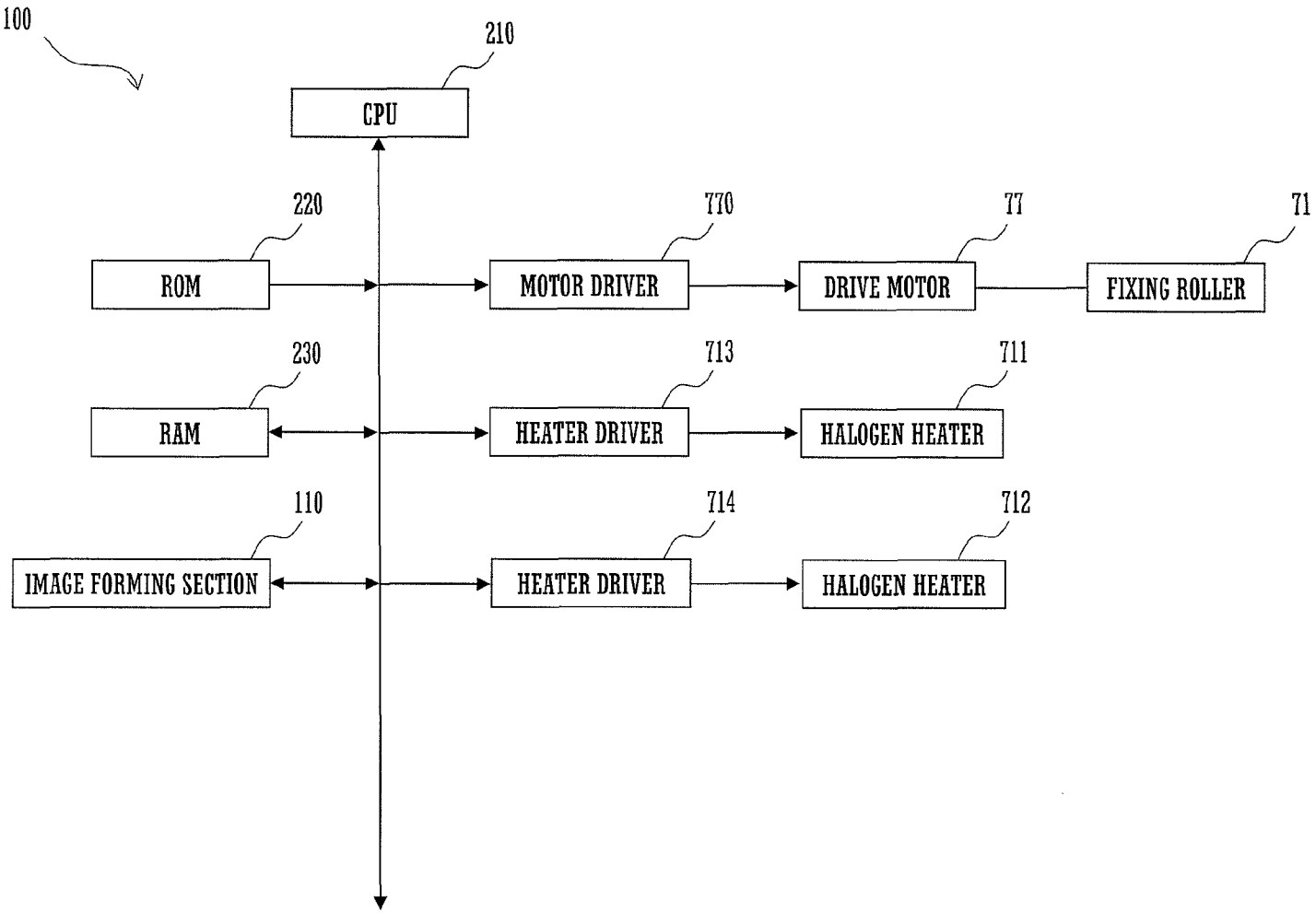
FIG. 3 is a block diagram illustrating a relevant portion of the image forming apparatus according to the first embodiment of the present invention.

FIG. 3 is a block diagram illustrating a relevant portion of the image forming apparatus 100 according to the first embodiment of the present invention.

The image forming apparatus 100 includes CPU 210, ROM 220, RAM 230, image forming section 110, motor driver 770, drive motor 77, fixing roller 71, heater drivers 713 and 714, and halogen heaters 711 and 712.

The CPU 210 reads a control program from the ROM 220 and executes it to control the rotation of the fixing roller 71 and the operations of the halogen heaters 711 and 712. The RAM 230 is utilized as a working area for the CPU 210. The image forming section 110 plays the role of determining the number of consecutive sheet surfaces having passed through the fixing unit 70 during an image forming operation of the image forming apparatus 100. Specifically, the CPU 210 is capable of determining the number of consecutive sheet surfaces based on a time period that has been taken for the image forming section 110 to change from an image forming state to a print standby state.

The motor driver 770 drives the drive motor 77 based on control signals from the CPU 210. The drive motor 77 causes the fixing roller 71 to rotate. The heater drivers 713 and 714 drive the halogen heaters 711 and 712, respectively, based on control signals from the CPU 210.

When the CPU 210 determines that the fixing roller 71 and the pressurizing roller 72 have performed fixing on a predetermined number and more of consecutive sheet surfaces, the CPU 210 carries out a first control process which causes the halogen heaters 711 and 712 to stop and the fixing roller 71 to rotate for a first predetermined time period after the fixing.

The first control process carried out by the CPU 210 is specifically described below with reference to FIG. 4.

Figure 4:
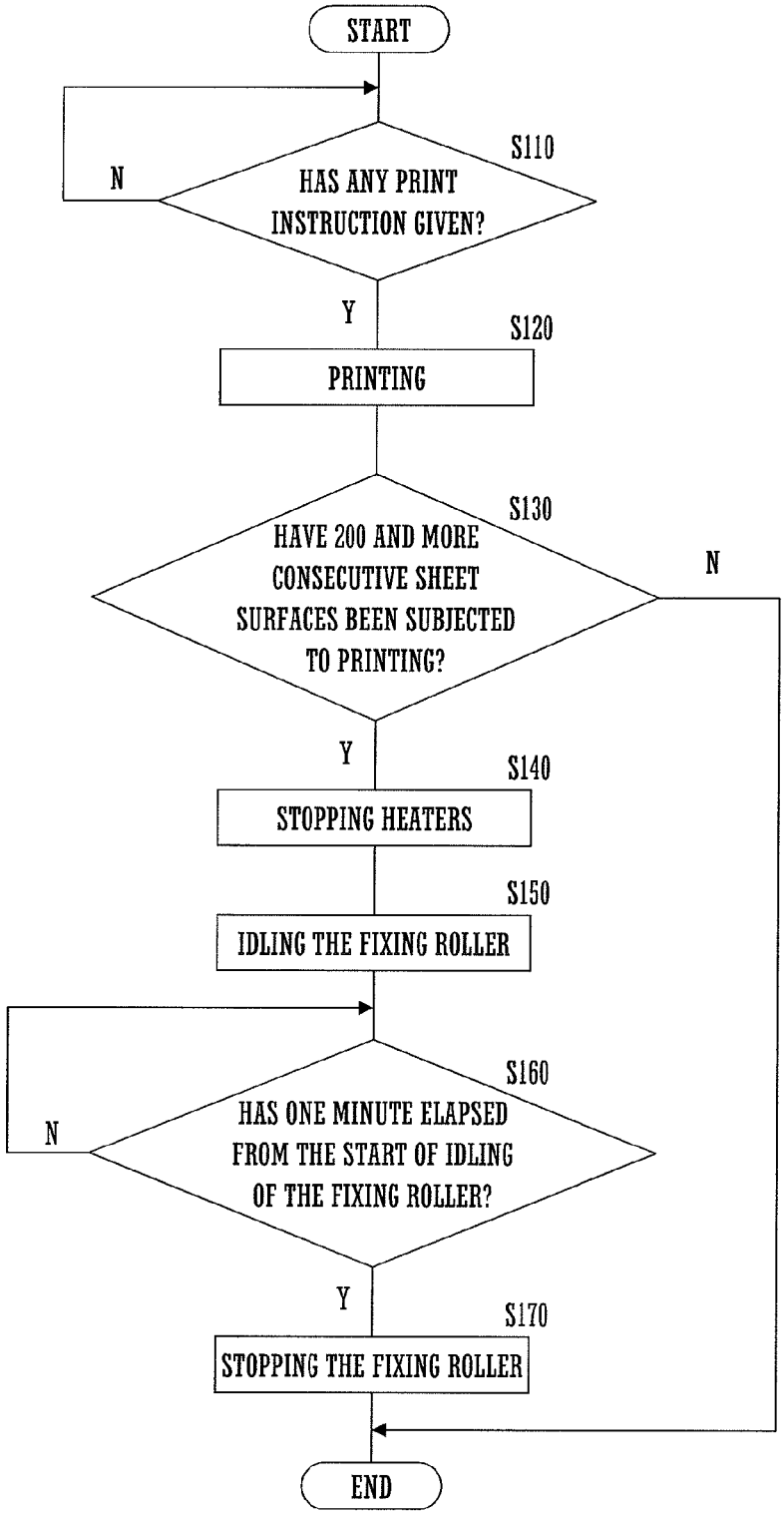
FIG. 4 is a flowchart of a first control process carried out by the image forming apparatus according to the first embodiment of the present invention.

FIG. 4 is a flowchart of the first control process carried out by the image forming apparatus 100 according to the first embodiment of the present invention.

The CPU 210 waits until a print instruction is given (in the case of NO in step S110). If the CPU 210 determines that the print instruction has been given (in the case of YES in step S110), the CPU 210 causes printing to start (step S120). Upon completion of the printing (step S120), the CPU 210 determines whether or not 200 and more consecutive sheet surfaces have been subjected to printing (step S130). In the present embodiment, the predetermined number of consecutive sheet surfaces is set to 200.

If the CPU 210 does not determine that 200 and more consecutive sheet surfaces have been subjected to printing (in the case of NO in step S130), the CPU 210 terminates the control process according to the present embodiment. Alternatively, if the CPU 210 determines that 200 and more consecutive sheet surfaces have been subjected to printing (in the case of YES in step S130), the CPU 210 controls the heater drivers 713 and 714 to cause the halogen heaters 711 and 712 to stop (step S140) and then controls the motor driver 770 to cause the fixing roller 71 to idle (step S150).

Subsequently, the CPU 210 determines whether or not one minute has elapsed from the start of idling of the fixing roller 71 (step S160). In the present embodiment, the first predetermined time period is set to one minute. The CPU waits until one minute has elapsed from the start of idling of the fixing roller 71 (in the case of NO in step S160). If the CPU 210 determines that one minute has elapsed from the start of idling of the fixing roller 71 (in the case of YES in step S160), the CPU 210 controls the motor driver 770 to cause the fixing roller 71 to stop idling (step S170) and terminates the control process according to the present embodiment.

In cases where a print instruction is given during the steps S150 and S160 of this control process, the CPU 210 switches the image forming apparatus 100 to a ready mode in which the surface temperature of the fixing roller 71 is kept at the fixing temperature by driving the halogen heaters 711 and 712 and then terminates the control process according to the present embodiment. This operation is performed to start printing earlier and shorten the user wait time.

The present embodiment gives a priority to a transition time taken for the image forming apparatus 100 to be switched to a standby mode in which the surface temperature of the fixing roller 71 is kept slightly lower than the fixing temperature. That is, when the transition time taken for the image forming apparatus 100 to be switched to the standby mode is equal to and more than one minute, the image forming apparatus 100 is switched to the ready mode, whereas, when the transition time is less than one minute, the image forming apparatus 100 is switched to the standby mode.

When the first cleaning roller 75 is heated enough to allow toner stain to ooze out of the surface thereof due to printing on 200 and more consecutive sheet surfaces, the CPU 210 carries out the first control process which can cool the first cleaning roller 75 sufficiently to retain the toner stain in the first cleaning roller 75.

Therefore, the toner stain fails to ooze out of the surface of the first cleaning roller 75 and hence fails to be fixed firmly. For this reason, the image forming apparatus 100 is capable of preventing sheets from being stained.

Description is directed to a second embodiment of the present invention. Redundant description is omitted of features of the second and third embodiments that are common to the first embodiment.

The image forming apparatus 100 according to the present embodiment can be switched to the ready mode or a sleep mode in which the halogen heaters 711 and 712 are stopped for power saving. When the CPU 210 according to the present embodiment determines that the fixing roller 71 and the pressuring roller 72 have performed fixing on the predetermined number and more of consecutive sheet surfaces just before switching from the ready mode to the sleep mode or just before powering off, the CPU 210 carries cut a second control process which causes the fixing roller 71 to rotate for a second predetermined time period after completion of switching from the sleep mode or a power off state to the ready mode while raising the surface temperature of the fixing roller 71 by a predetermined temperature increase from that in the ready mode. The second control process will be described specifically with reference to FIG. 6.

Figure 5:
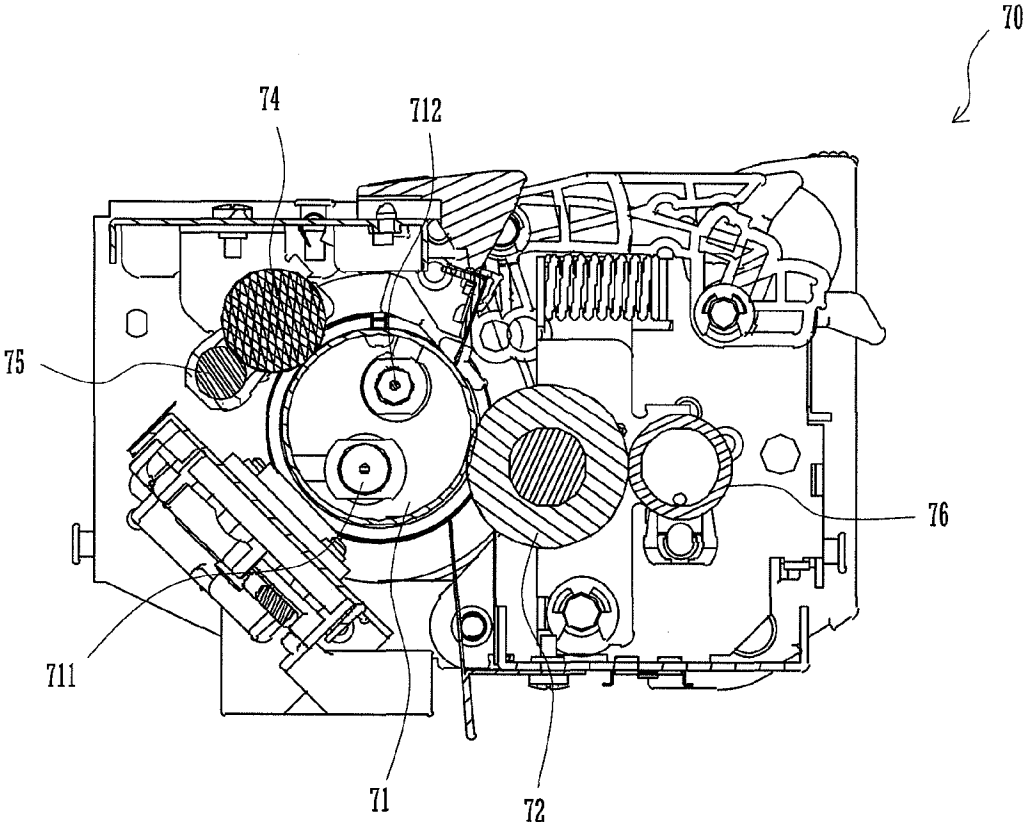
FIG. 5 is a view illustrating a structure of a fixing unit incorporated in an image forming apparatus according to a second embodiment of the present invention.

FIG. 5 is a view illustrating a structure of the fixing unit 70 incorporated in the image forming apparatus 100 according to the second embodiment of the present invention.

The fixing unit 70 includes a second cleaning roller 76 in addition to the components of the first embodiment. The second cleaning roller 76 abuts against the pressurizing roller 72 and is rotated by rotation of the pressurizing roller 72. The second cleaning roller 76 is a roller for cleaning the surface of the pressurizing roller 72. The present embodiment uses a hollow metal roller as the second cleaning roller 76.

Figure 6:
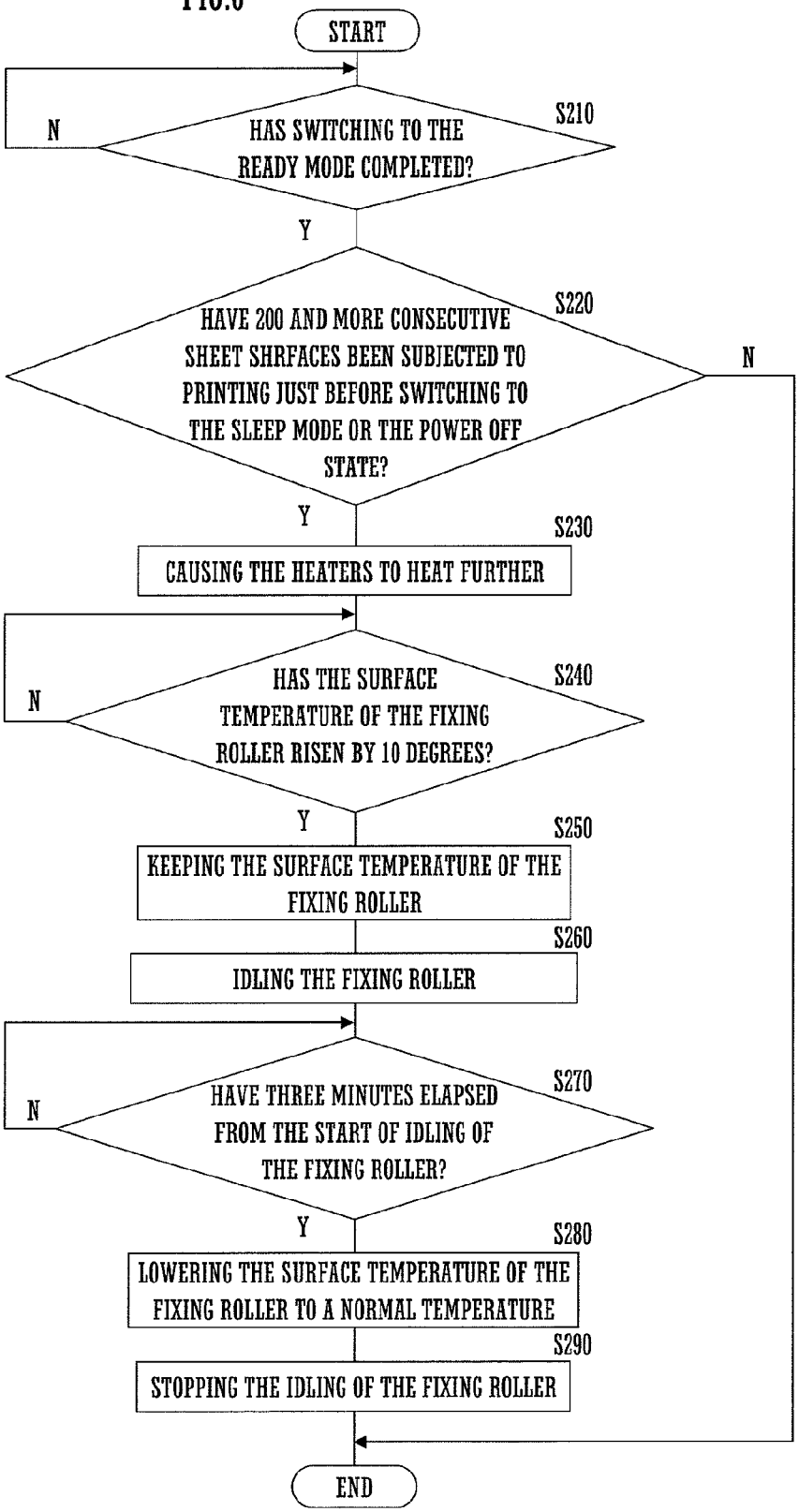
FIG. 6 is a flowchart of a second control process carried out by the image forming apparatus according to the second embodiment of the present invention.

FIG. 6 is a flowchart of the second control process carried out by the image forming apparatus 100 according to the second embodiment of the present invention.

The flowchart starts during transition of the image forming apparatus 100 from the sleep mode or the power off state to the ready mode. That is, the flowchart starts during heating of the fixing roller 71.

The CPU 210 waits until switching of the image forming apparatus 100 to the ready mode has completed (in the case of NO in step S210). If the CPU 210 determines that the switching of the image forming apparatus 100 to the ready mode has completed (in the case of YES in step S210), the CPU 210 determines whether or not 200 and more consecutive sheet surfaces have been subjected to printing just before switching to the sleep mode or the power off state (step S220). In the present embodiment, the predetermined number of consecutive sheet surfaces is set to 200.

If the CPU 210 does not determine that 200 and more consecutive sheet surfaces have been subjected to printing just before the switching to the sleep mode or the power off state (in the case of NO in step S220), the CPU 210 terminates the control process according to the present embodiment. Alternatively, if the CPU 210 determines that 200 and more consecutive sheet surfaces have been subjected to printing just before the switching to the sleep mode or the power off state (in the case of YES in step S220), the CPU 210 controls the heater drivers 713 and 714 to cause the halogen heaters 711 and 712 to heat further (step S230).

Subsequently, the CPU 210 waits until the surface temperature of the fixing roller 71 has risen by 10 degrees from that in the ready mode (in the case of NO in step S240). In the present embodiment, the predetermined temperature increase is set to 10 degrees. If the CPU 210 determines that the surface temperature of the fixing roller 71 has risen by 10 degrees from that in the ready mode (in the case of YES in step S240), the CPU 210 keeps the surface temperature of the fixing roller 71 at that temperature Step S250) and then controls the motor driver 770 to cause the fixing roller 71 to idle with its surface temperature kept as it is (step S260).

Subsequently, the CPU 210 determines whether or not three minutes have elapsed from the start of idling of the fixing roller 71 (step S270). In the present embodiment, the second predetermined time period is set to three minutes. The CPU waits until three minutes have elapsed from the start of idling of the fixing roller 71 (in the case of NO in step S270). If the CPU 210 determines that three minutes have elapsed from the start of idling of the fixing roller 71 (in the case of YES in step S270), the CPU 210 controls the heater drivers 713 and 714 to lower the surface temperature of the fixing roller 71 to that in the ready mode (step S280) and then controls the motor driver 770 to cause the fixing roller 71 to stop idling (step S290). In this way, the control process according to the present embodiment is terminated.

In cases where a print instruction is given during this control process, the CPU 210 does not allow printing to start until the step S270 has completed. This is to ensure reliable removal of toner stain that is firmly fixed after having oozed out of the surface of the first cleaning roller 75.

In cases where the first cleaning roller 75 is heated enough to allow toner stain to ooze out of the surface thereof due to printing on 200 and more consecutive sheet surfaces and then the toner stain thus oozing out is firmly fixed to the first cleaning roller 75 due to switching of the image forming apparatus 100 to the sleep mode or the power off state, the image forming apparatus 100 carries out the second control process which can heat the first cleaning roller 75 sufficiently to melt the fixed toner stain and then recover the toner stain thus melted by means of the second cleaning roller 76. That is, the toner firmly fixed to the first cleaning roller 75 is transferred to the oil roller 74, fixing roller 71 and pressurizing roller 72 sequentially and then finally reaches the second cleaning roller 76.

Therefore, the toner stain having oozed out of the surface of the first cleaning roller 75 and then firmly fixed thereto is removed from the first cleaning roller 75. For this reason, the image forming apparatus 100 is capable of preventing sheets from being stained.

Description is directed to a third embodiment of the present invention.

Figure 7:
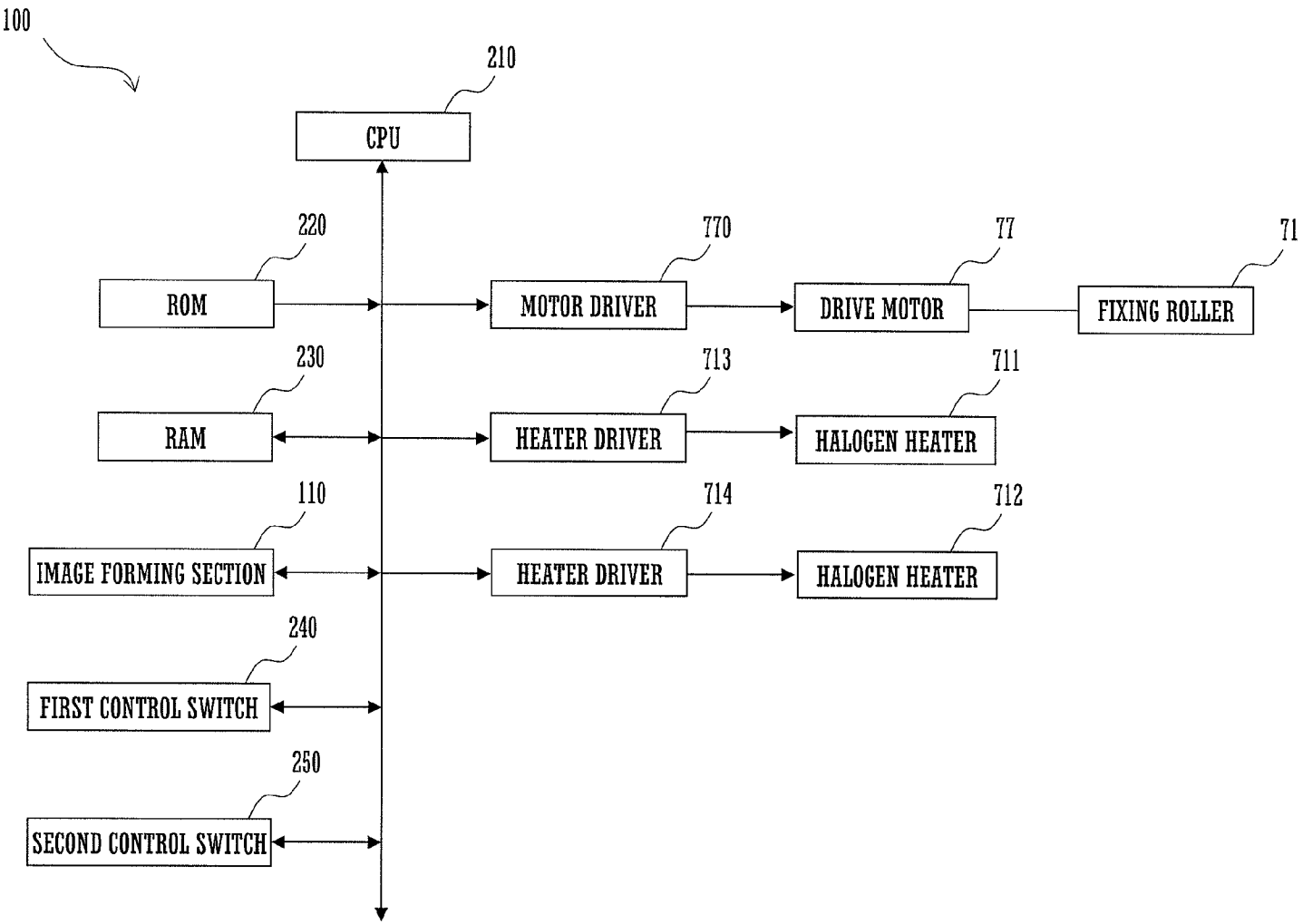
FIG. 7 is a block diagram illustrating a relevant portion of an image forming apparatus according to a third embodiment of the present invention.

FIG. 7 is a block diagram illustrating a relevant portion of the image forming apparatus 100 according to the third embodiment of the present invention.

The image forming apparatus 100 according to the present embodiment includes a first control switch 240 and a second control switch 250 in addition to the components of the first embodiment.

The first control switch 240 is a switch for selecting whether or not the CPU 210 has to carry out the first control process. For example, when the first control switch 240 is ON, the CPU 210 carries out the first control process. On the other hand, when the first control switch 240 is OFF, the CPU 210 does not carry out the first control process.

The second control switch 250 is a switch for selecting whether or not the CPU 210 has to carry out the second control process. For example, when the second control switch 250 is ON, the CPU 210 carries out the second control process. On the other hand, when the second control switch 250 is OFF, the CPU 210 does not carry out the second control process.

This feature makes it possible to select whether or not the CPU 210 has to carry out the first control process and whether or not the CPU 210 has to carry out the second control process. Therefore, the third embodiment can flexibly accommodate to use conditions of the user.

While the first to third embodiments have been described above, the scope of the present invention is not limited to the foregoing embodiments. The present invention may be practiced by combining these embodiments as desired.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

What is claimed is:

1. An image forming apparatus comprising:

a fixing roller;

a heating section for heating the fixing roller;

a pressurizing roller pressed against the fixing roller;

an oil roller abutting against the fixing roller and capable of being rotated by rotation of the fixing roller to apply oil onto a surface of the fixing roller;

a first cleaning roller abutting against the oil roller and capable of being rotated by rotation of the oil roller to clean a surface of the oil roller; and a control section configured to control the rotation of the fixing roller and an operation of the heating section, wherein when the control section determines that the fixing roller and the pressurizing roller have performed fixing on a predetermined number and more of consecutive sheet surfaces, the control section carries out a first control process which causes the heating section to stop and the fixing roller to rotate for a first predetermined time period after the fixing.

2. The image forming apparatus according to claim 1, which is switchable to a ready mode in which a surface temperature of the fixing roller is kept at a fixing temperature or a sleep mode in which heating section is stopped for power saving and which further comprises a second cleaning roller abutting against the pressurizing roller and capable of being rotated by rotation of the pressurizing roller to clean a surface of the pressurizing roller, wherein when the control section determines that the fixing roller and the pressurizing roller have performed fixing on the predetermined number and more of consecutive sheet surfaces just before switching from the ready mode to the sleep mode or just before powering off, the control section carries out a second control process which causes the fixing roller to rotate for a second predetermined time period after completion of switching from the sleep mode or a power off state to the ready mode while raising the surface temperature of the fixing roller by a predetermined temperature increase from that in the ready mode.

3. The image forming apparatus according to claim 2, wherein the control section is capable of selecting whether or not to carry out the first control process and whether or not to carry out the second control process.

4. The image forming apparatus according to claim 1, wherein the first cleaning roller is a solid metal roller.

5. The image forming apparatus according to claim 1, wherein the oil roller is a sponge roller.

* * * * *